US007717263B2

(12) United States Patent
Evans et al.

(10) Patent No.: US 7,717,263 B2
(45) Date of Patent: May 18, 2010

(54) SUPPORT SYSTEMS FOR PORTABLE CONTAINERS

(76) Inventors: Kirk Boyd Evans, 1690 E. San Tan St., Chandler, AZ (US) 85225; Wayne Kirk Evans, 1540 E. Carla Vista Dr., Chandler, AZ (US) 85225

( * ) Notice: Subject to any disclaimer, the term of this patent is extended or adjusted under 35 U.S.C. 154(b) by 0 days.

(21) Appl. No.: 11/872,010

(22) Filed: Oct. 13, 2007

(65) Prior Publication Data

US 2008/0029657 A1 Feb. 7, 2008

Related U.S. Application Data

(63) Continuation-in-part of application No. 11/073,154, filed on Mar. 5, 2005, now Pat. No. 7,353,943.

(51) Int. Cl.
*A63B 55/10* (2006.01)
*A45C 13/38* (2006.01)

(52) U.S. Cl. ..... 206/315.7; 206/315.4; 190/18 R; 190/108; 248/96

(58) Field of Classification Search ..... 206/315.4, 206/315.7; 248/96, 95, 97, 688; 190/1, 14, 190/18 R, 102, 108
See application file for complete search history.

(56) References Cited

U.S. PATENT DOCUMENTS 1,791,188 A 2/1931 Bright
1,811,296 A 6/1931 Boden et al.
1,924,182 A 8/1933 Fritz
1,954,413 A 4/1934 Hunter
1,982,388 A * 11/1934 Huehn ..... 248/96
2,282,842 A 5/1942 Abell
2,283,412 A * 5/1942 Bright ..... 206/315.5
2,352,794 A * 7/1944 Love ..... 248/168
2,602,676 A * 7/1952 Fieldhouse ..... 280/47.12
3,195,844 A 7/1965 Roepke
3,352,390 A * 11/1967 Zalkind et al. ..... 190/100
4,087,068 A 5/1978 Gardner
4,226,389 A 10/1980 Neth
4,228,877 A 10/1980 Cothary
4,647,056 A 3/1987 Baker
4,739,958 A 4/1988 Sato
4,761,012 A 8/1988 Dames
4,767,001 A 8/1988 Kim
4,887,751 A * 12/1989 Lehman ..... 224/579
4,898,352 A 2/1990 Hoffman
4,915,332 A 4/1990 Ouellette
4,979,598 A 12/1990 Verheij et al.
5,082,218 A 1/1992 Hoffman
5,456,355 A 10/1995 Usswald et al.
5,470,095 A * 11/1995 Bridges ..... 280/646

(Continued)

*Primary Examiner*—Sue A Weaver
(74) *Attorney, Agent, or Firm*—Keith L. Jenkins, Registered Patent Attorney, LLC; Keith L. Jenkins

(57) ABSTRACT

Portable container support systems are disclosed which include at least one re-closable enclosure which is operable to be coupled to the exterior of a portable container, and which has an integral support coupling adapted to receive supports used for supporting the portable container in a preferred orientation, such as a nearly vertical position for use as a rack for assembled articles. Various re-closable enclosures are disclosed which enable convenient deployment of support legs while providing protection for the supports when stowed for transport. The system may be used with a wide variety of portable containers, such as pool cue cases, golf bags, equipment bags, etc.

18 Claims, 14 Drawing Sheets

U.S. PATENT DOCUMENTS 5,472,084 A * 12/1995 Aliano, Jr. ..... 206/315.3
5,632,496 A * 5/1997 Nelson ..... 280/30
5,829,585 A * 11/1998 Kao et al. ..... 206/315.3
5,904,326 A * 5/1999 Riu ..... 248/96
5,960,952 A * 10/1999 Chen ..... 206/320
6,145,801 A * 11/2000 Herring, Jr. ..... 248/463
6,186,520 B1 * 2/2001 Barten ..... 280/30
6,253,913 B1 * 7/2001 Suk ..... 206/315.5
D465,325 S 11/2002 Lin
6,508,359 B1 1/2003 He et al.
6,561,348 B2 5/2003 Kuo
6,786,460 B1 * 9/2004 Kelly ..... 248/96
6,817,469 B2 * 11/2004 Chang ..... 206/315.7
D509,956 S 9/2005 Lin
7,208,666 B2 * 4/2007 Burch et al. ..... 84/327
7,287,765 B2 * 10/2007 Murphy et al. ..... 280/47.26
2002/0043474 A1 4/2002 Hamamori
2002/0066763 A1 * 6/2002 Hsueh ..... 224/901.2
2003/0111369 A1 6/2003 Markowitz
2004/0026199 A1 2/2004 Chen
2005/0051982 A1 3/2005 Su
2007/0045992 A1 * 3/2007 Jackson ..... 280/655

* cited by examiner

SUPPORT SYSTEMS FOR PORTABLE CONTAINERS

RELATED APPLICATIONS

This utility patent application is a continuation-in-part of U.S. patent application Ser. No. 11/073,154 to the same inventors.

FIELD OF THE INVENTION

The present invention relates to a pool cue portable container support system including a pool cue portable container for transporting pool cue sticks that is reconfigurable as a stand for pool cue sticks, and more particularly to a pool cue portable container system having at least one stowable support in an optionally detachable external re-closable enclosure. The present invention is useful for supporting portable containers in preferred orientations generally.

BACKGROUND OF THE INVENTION

Pool cue sticks are used for shooting pool and in related billiard games. A pool cue stick having two-piece construction typically has a coupling between the pool cue shaft and the handle portion that may be connected or disconnected by hand. Two-piece cue sticks may be transported in a pool cue portable container when disassembled. Pool cue cases for two-piece cues are generally cylindrical tubes, of various cross-sectional shapes, that are slightly longer than the shaft and handle of a disassembled pool cue stick. A pool cue portable container may have an insert, such as polyurethane foam insert, that substantially fills the interior of the portable container except for tapered bores in the insert adapted to receive disassembled cue sticks. Commercially available pool cue cases may have a handle, carrying strap, and/or one or more zippered pouches attached to the exterior of the pool cue portable container with straps. Zippered pouches may be used for carrying such essentials as chalk, spare tips spare ferrules, and similar game-related supplies and paraphernalia, for example.

When a pool player transports his cue sticks in a pool cue portable container to a tournament, he encounters at least two problems, as recognized by the present inventors. First, once the pool cue sticks are removed from the pool cue portable container and assembled, there is often no place to safely and securely place the pool cue sticks while not in actual use. A player may have different cues for different purposes. For example, he may have a break cue, a jump cue, and a shooting cue. Accordingly, a shooter may need a safe and secure place for two of his cues, even while shooting with one cue. At tournaments, it is common for wall racks for pool cue sticks to be inadequate for the crowd, and pool cue sticks can end up propped up against a wall or laid on the floor. Some pool cue sticks cost thousands of dollars, and such precarious temporary storage in crowded tournament rooms risks serious damage to the pool cue stick.

Second, there is no provision for storing the pool cue cases at many tournaments. As a result, the cases are often left on chairs, countertops, floors, tables, and other inconvenient places, adding annoyance to an already crowded room. The cases need to be kept in general proximity to the players for access to the contents thereof and for security. Players may move 50 feet or more between games and so may have to retrieve their cases after each game and carry their assembled cue sticks and their cases to the next game. This is cumbersome with current technology. In tournament play, shooters often have to wait a substantial amount of time between games. During this waiting time, the shooter wants to have a way to protect the cue sticks neatly out of the way while avoiding having to keep them in hand or having the cue sticks precariously laying about the tournament room.

Some attempts to partially solve each one of these problems have been made without great commercial success. For example, U.S. Pat. No. 4,898,352 (expired) to Hoffman disclosed a container stand, which could be a pool stick portable container, with deployable support legs attached to the exterior of the portable container to support the portable container in a nearly upright position. The legs could be attached directly to the portable container or to a strap that could then be secured to the portable container. The legs and bracket were exposed on the outside of the portable container, creating a risk of damage to the legs and to other luggage. In U.S. Pat. No. 5,082,218 (expired), Hoffman further disclosed retaining means for holding the legs adjacent to the portable container when not in use supporting the portable container. In U.S. Pat. No. 4,915,332 (expired) to Ouelette disclosed a portable Pool Cue Holder with deployable legs internally stowable in the cylindrical holder. Ouelette's holder appears vertical with a tripod stand that provides a significant increase in the footprint of the device when in use. Ouelette's holder discloses a preference that the holder be small, having a preferred height of 5¼ inches and a cylinder diameter of 1⅝ inches, holding one pool cue while the pool cue is not in use.

The present inventors have identified and isolated the problems: what is lacking are apparatuses (together comprising a pool cue portable container system) which enable pool cues and pool cue cases to be kept both neatly out of the way (such as near a table in a waiting area) and readily at hand during tournament play. Another problem identified by the present inventors is for a pool cue portable container for two-piece pool cues to be used as an assembled pool cue stand with reduced risk of damage to the support legs and to adjacent luggage during transport. The present inventors also identified the need for a pool cue portable container that may act as a pool cue stand for a plurality of assembled pool cues, and that is big enough to be seen in a crowded room and that has a reduced foot print on the floor.

The present inventors have also identified that the problem of supporting a pool cue portable container is similar to the problem of supporting portable containers generally. For example, and without limitation, golf bags; luggage; musical instrument cases; sports equipment bags, such as those used for baseball, skiing, fencing, and lacrosse; bags generally; briefcases; and computer cases.

Accordingly, what is needed is a pool cue portable container system with supports that enable the pool cue portable container to be supported in a nearly upright position on a floor. A further need is that the supports are stowable for transport, if not within the portable container, then within a re-closable enclosure, such as a zippered pouch, removably attached to the exterior of the main portable container tube. A further need is that the supports can be releasably coupled to the portable container by being coupled to a re-closable enclosure releasably attached to the exterior of the main portable container tube. Another need is for supports to be coupled to an interior surface of a re-closable enclosure releasably attached to the exterior of the main portable container tube and for the floor-engaging ends of the supports to be deployable out of the re-closable enclosure. A further need is for the option to have the supports constantly coupled to the re-closable enclosure. A further need is for the supports to be extendable. Yet a further need is for the deployment of the legs to not increase the footprint of the pool cue portable container on the floor. Yet another need is for the pool cue portable container system to accommodate a plurality of assembled pool cues, so that an unused cue will normally be in the nearly upright pool cue portable container. Yet another need is for a re-closable enclosure having deployable supports. Yet another need is for the re-closable enclosure to be operable to be coupled to a pool cue portable container. Yet another need is for re-closable enclosures having deployable supports that are sized, shaped, and arranged to support various portable containers, including cases and bags. To meet the above-mentioned needs and to solve the above-mentioned problems, applicants present what follows.

BRIEF SUMMARY OF THE INVENTION

One embodiment of the present invention provides a portable container with a re-closable enclosure operable to be releasably coupled to the exterior of the portable container, a support for the portable container that is internally stowable within the re-closable enclosure, and a support coupling coupled to the re-closable enclosure. Another embodiment provides a portable container having a portable container reconfigurer operable to enable the pool cue portable container to support, in an inclined position, assembled disconnected sections of a pool cue, and a re-closable enclosure, operable to be releasably coupled externally to the portable container and operable to enclose at least part of the portable container reconfigurer in a stowed position. Another embodiment of the present invention provides a re-closable enclosure further having a support coupling coupled to at least a portion of the re-closable enclosure, a support having a proximal end operable to be coupled to the support coupling and a distal end at least partially deployable outside the re-closable enclosure, and at least one adaptation for enabling releasable coupling of the re-closable enclosure with a portable container to be supported. Additional embodiments provide various instantiations of design for the re-closable enclosure, supports, support coupling, and adaptations for coupling the re-closable enclosure to the portable container, including couplings that are part of the re-closable enclosure.

BRIEF DESCRIPTION OF THE DRAWINGS

The above and other objects and advantages of the present invention will become more apparent from the following description taken in conjunction with the following drawings in which.

DETAILED DESCRIPTION OF THE DRAWINGS

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
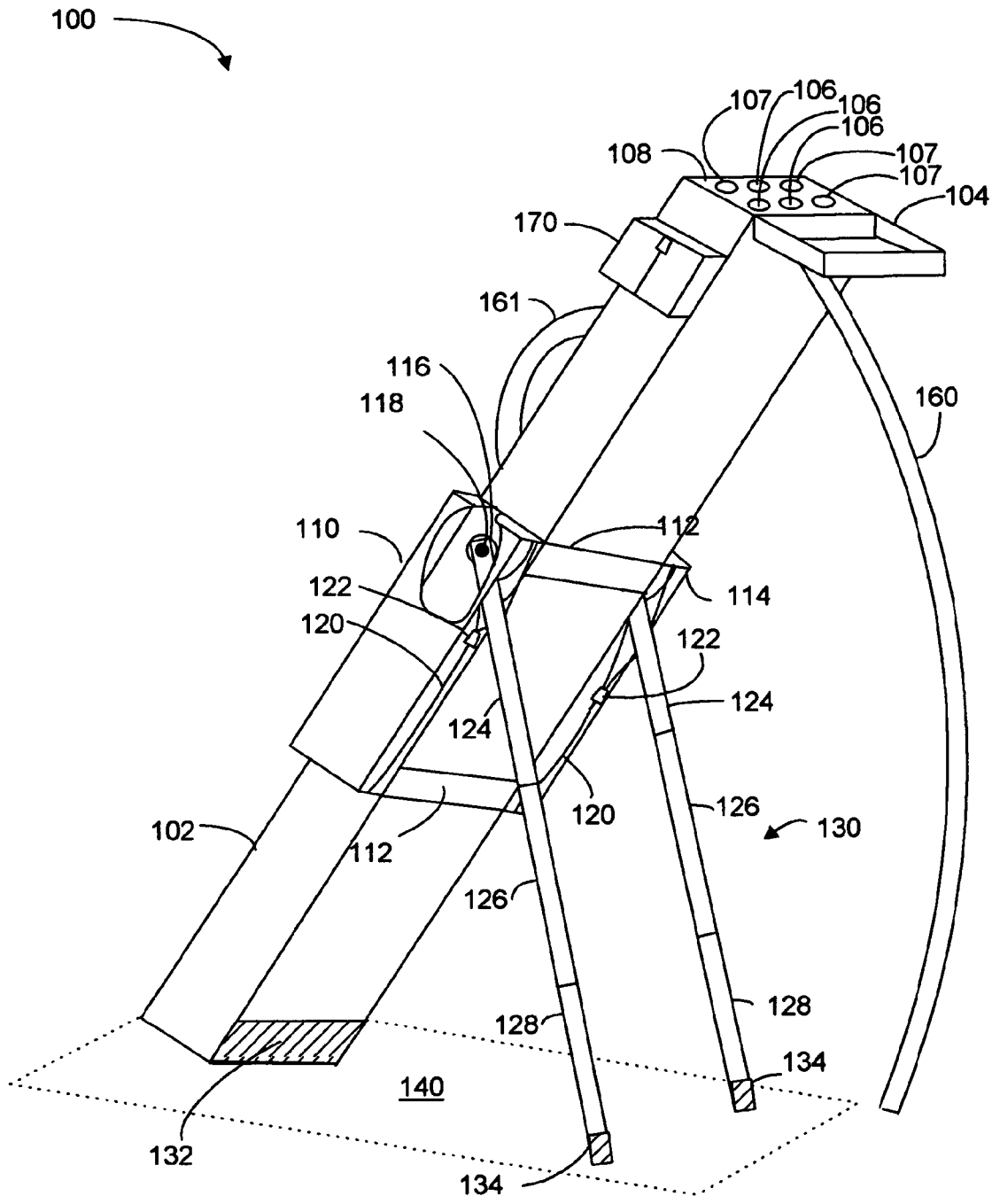
FIG. 1 is a perspective view illustrating a first exemplary embodiment of the portable container support system, or pool cue case support system, according to the present invention.

FIG. 1 is a perspective view illustrating a first exemplary embodiment of the portable container support system, or pool cue support system 100, according to the present invention. Pool cue portable container 102 is illustrated as a generally rectangular cylindrical tube containing a core material 108, which has a plurality of pool cue shaft bores 107 and pool cue handle bores 106 for receiving portions of a pool cue stick. Pool cue portable container 102 has a lid 104 for covering the ends of pool cue shafts and handles during storage and transport. Releasably coupled to the exterior of the portable container 102 are re-closable enclosures 110 and 114 from which supports 130 extend to support the portable container in a nearly vertical position. The re-closable enclosures 110 and 114 are preferably made of leather at least ⅛-inch thick or other semi-rigid material capable of protecting the supports 130 from damage when stowed for transport within re-closable enclosures 110 and 114. Each re-closable enclosure 110 and 114 has a closure 120 and a closure actuator 122. The closure is preferably a continuous closure, such as a zipper, a zip-lock, or a hook and loop fastener. Those skilled in the art, upon reading the teachings of this specification, will appreciate that, under appropriate circumstances, considering such issues as user preferences, ergonomic factors, and cost, other types of closures, such as snaps, buttons, and the like, may suffice.

Re-closable enclosures 110 and 114 are coupled to the pool cue portable container by releasable couplings 112. The releasable couplings 112, illustrated as straps, are preferably integral to the re-closable enclosures 110 and 114. In some embodiments, the releasable couplings 112 may be separable from the re-closable enclosures 110 and 114. For example, the re-closable enclosures 110 and 114 may have adaptations, such as slots, for receiving releasable couplings 112, such as straps. For the exemplary embodiment using straps for releasable couplings 112, the straps may be fastened by any means known in the art, including hook and loop fasteners, buckles, snaps, and the like. Preferably, the re-closable enclosures 110 and 114 are adjustable to various positions on the pool cue portable container 102. Preferably, the supports 130 are positionable, when deployed, to provide no increase in the footprint 140 of the pool cue portable container 102 and any attached enclosures, such as re-closable enclosures 110 and 114.

In a preferred embodiment, additional enclosures 170 for chalk, shooting bridges, and other paraphernalia are also coupled to the exterior of portable container 102. Likewise, in a preferred embodiment, a carrying handle 161 and a shoulder strap 160 (shown partially connected for clarity of the drawing: the disconnected end attaches near the foot 132), are also coupled to the outside of the pool cue portable container 102. Those skilled in the art, upon reading the teachings of this specification, will appreciate that, under appropriate circumstances, considering such issues as market forces, user preferences, and portability, other releasable couplings 112, such as snaps, clamps, locks, etc., may suffice.

In another preferred embodiment, re-closable enclosures 110 and 114 are sized for the dual role of stowing the supports 130 and carrying the chalk, shooting bridges, and other paraphernalia. Those skilled in the art, upon reading the teachings of this specification, will appreciate that, under appropriate circumstances, considering such issues as market forces, user preferences, and ergonomics, other shapes, sizes, and numbers of re-closable enclosures 110 and 114, adapted to a particular portable container shape, handle 161 position, carrying strap 160 position, and the positions and sizes of other enclosures 170 coupled to the exterior of pool cue portable container 102, etc., may suffice.

Supports 130 may be of any substantially rigid material and are preferably comprised of a lightweight material such as aluminum, boron-epoxy composite, titanium, plastic, and the like. Supports 130 are preferably extendable legs, each comprised of segments 124, 126, and 128, which are preferably extendable by telescoping. The segments 124, 126, and 128 are preferably sized to fit within the re-closable enclosure 110 or 114 for stowage during transport and storage. In a preferred embodiment, the supports 130 are extendable legs that are preferably spring-biased with a release mechanism that can be actuated to extend the supports 130. In another preferred embodiment, a closed re-closable enclosure 110 or 114 constrains a spring bias in the telescoping extendable leg supports 130 such that each of the supports 130 extend automatically when its respective re-closable enclosure 110 or 114 is opened. Other types of supports 130, such as folding legs (including folding tent-pole-type legs with internal elastic cord connecting the segments 124, 126, and 128), discrete connectable segments, scissor-action legs, and articulated legs with locks are preferred in various other preferred embodiments. Those skilled in the art, upon reading the teachings of this specification, will appreciate that, under appropriate circumstances, considering such issues as market forces, user preferences, and material properties, other supports, such as pedestals, tripods, and legs of various decorative or adaptive shapes, may suffice.

Each support 130 is preferably flexibly coupled to the re-closable enclosure 110 or 114. The flexible support coupling 118 is configured to enable deployment of supports 130 in a tripod configuration with the pool cue portable container 102 forming one tripod leg, as shown. The support coupling 118 may include spring bias toward the extended, or deployed, position or toward preferential positioning, such as by a détente in coupling base 116. Other flexible support couplings 118 between the support and the re-closable enclosure 110 are also preferred in various preferred embodiments and may include any type of support coupling 118 as known in the art. For example, the art of extendable card table supports and the art of extendable golf-bag supports provides numerous approaches to flexible support couplings 118 for supports 130 and for deploying the supports 130 to a preferred position. The support coupling 118 is preferably coupled directly to the re-closable enclosure 110 and at least part of the support coupling 118 is preferably permanently coupled to the re-closable enclosure 110. Those skilled in the art, upon reading the teachings of this specification, will appreciate that, under appropriate circumstances, considering such issues as market forces, user preferences, and material properties, other support couplings 118, such as two-axis couplings, universal couplings, and couplings integral with supports 130, etc., may suffice.

In yet another preferred embodiment, each support 130 is preferably flexibly coupled to the re-closable enclosure 110 or 114 and to the exterior of pool cue portable container 102 and covered by at least a portion of re-closable enclosure 110 or 114. While it is preferred to couple the support coupling 118 to an interior portion of the re-closable enclosure 110 or 114 adjacent the pool cue portable container 102, it will be appreciated that the support coupling 118 may be coupled to any portion of the re-closable enclosure 110 or 114.

Supports 130 preferably have high-friction feet 134 to reduce slippage. High-friction feet 134 maybe made of any suitable material, such as rubber, neoprene, and the like. High-friction feet 134 are preferably integral with segment 128. In another embodiment, high-friction feet 134 are preferably removable and stowable in re-closable enclosure 110 and/or 114 in an alternate preferred embodiment. Pool cue portable container 102 preferably has a high-friction foot 132 to reduce slippage. The high-friction foot 132 is preferably integral to pool cue portable container 102. In an alternate preferred embodiment, high-friction foot 132 is preferably removable and stowable in re-closable enclosure 110 or 114. Those skilled in the art, upon reading the teachings of this specification, will appreciate that, under appropriate circumstances, considering such issues as market forces, user preferences, and material properties, other high-friction feet 134 and high-friction foot 132, such as ribbed feet, swivel-mounted feet, angled feet, etc., may suffice.

Figure 2:
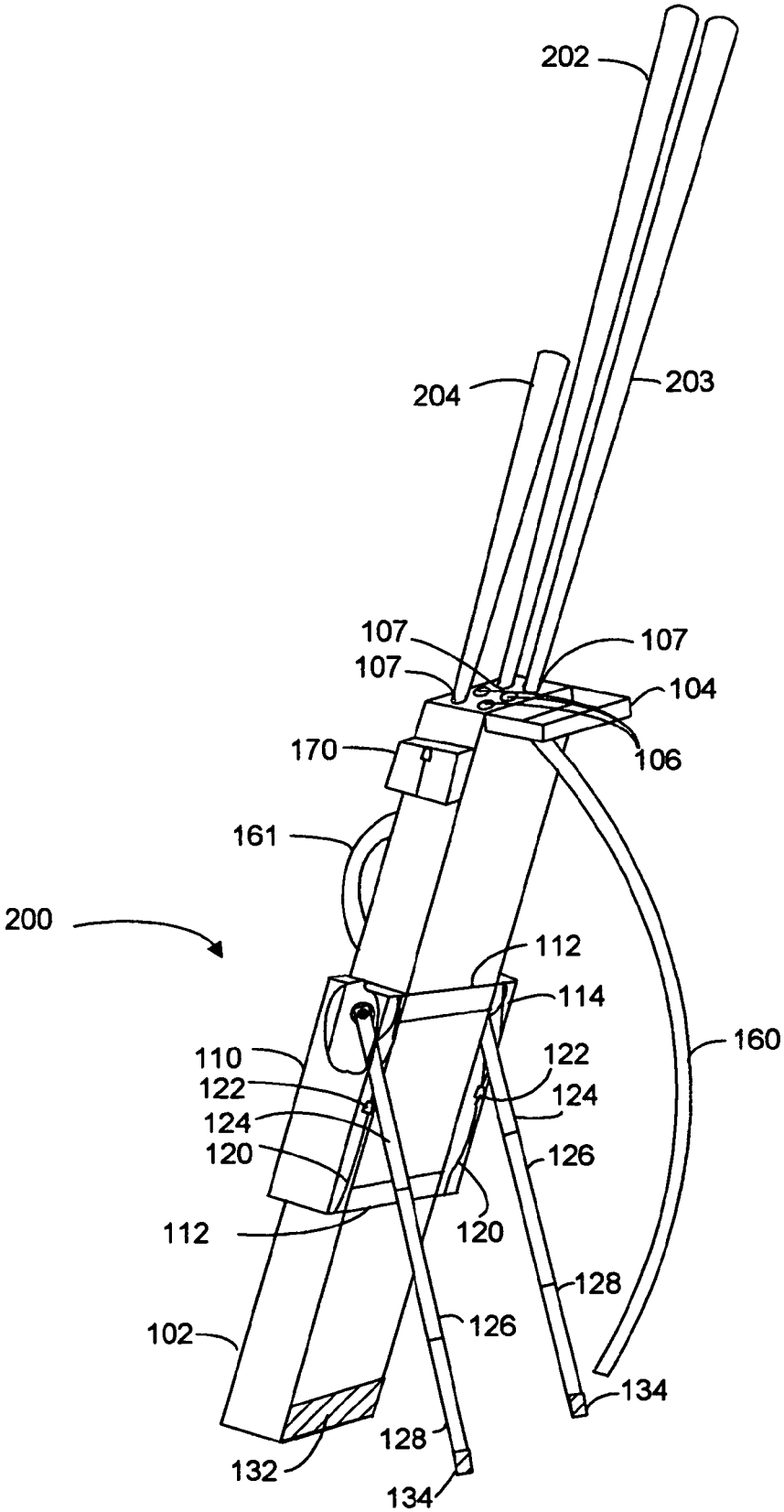
FIG. 2 is a perspective view illustrating an exemplary embodiment of the portable container support system, or pool cue support system, of FIG. 1 in use as a stand for a plurality of assembled pool cues.

FIG. 2 is a perspective view illustrating an exemplary embodiment 200 of a portable container support system, or pool cue support system 100, of FIG. 1 in use as a stand for assembled shooter cue 202, assembled break cue 230, and assembled jump cue 204. Pool cues 202-204 are illustrated in assembled configurations with the shaft ends of the pool cues 202-204 inserted into pool cue shaft bores 107. The pool cues 202-204 are readily available for use while taking up little floor space. Further, the pool cues 202-204 are relatively safe from being knocked over, impacted by furniture or clumsy persons, or otherwise damaged. Preferably, embodiment 200 will also have a carrying handle 161 and a shoulder strap 160 (shown partially connected for clarity of the drawing: the disconnected end attaches near the foot 132), as well as additional enclosures 170 coupled to the exterior of pool cue portable container 102. By keeping the cues 202-204 nearly vertical (preferably 60-89 angular degrees measured up from the floor), bending forces on the pool cues 202-204 are reduced, thereby reducing the likelihood of warping. Those skilled in the art, upon reading the teachings of this specification, will appreciate that, under appropriate circumstances, considering such issues as market forces, user preferences, and pool cue portable container 102 designs, other bores 107, such as a deeper, wider bore 107 to receive a longer portion of assembled pool cue 202-204, an extra bore specifically adapted to hold more than half of an assembled pool cue 202-204, closable openings in the lid 104 aligned to the bores 107, etc., may suffice.

Figure 3:
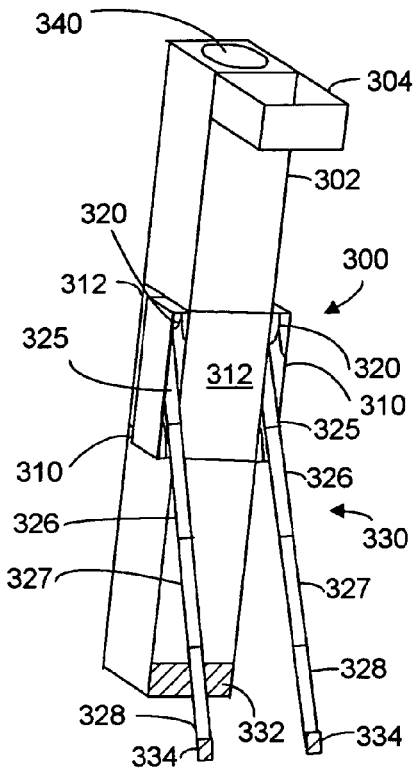
FIG. 3 is a perspective view illustrating a second exemplary embodiment of the portable container support system, or pool cue support system, according to the present invention.

FIG. 3 is a perspective view illustrating a second exemplary embodiment of the portable container support system, or pool cue support system 300, according to the present invention. Re-closable enclosures 310 are sized to receive little more than the extendable, segmented supports 330 for stowage. Segments 325, 326, 327, and 328 may be any type of extendable leg segments and are preferably telescoping and more preferably spring-biased telescoping segments. Releasable coupling 312, between the re-closable enclosures 310, and the pool cue portable container 302 is illustrated as a single, broad strap but may be any type of coupling that will releasably couple the re-closable enclosures 310 to the pool cue portable container 302. Bore 340 is a single large portable container interior space for holding a plurality of items together or individually wrapped or encased in removable covers. Closures 320 may be of any type, but are preferably zippers. Lid 304 is optional. In an alternate embodiment, portable container 303 may be sized for golf clubs and feet 332 and 334 may be adapted for non-floor surfaces, such as turf. Those skilled in the art, upon reading the teachings of this specification, will appreciate that, under appropriate circumstances, considering such issues as market forces, user preferences, and intended use, other enclosable supports 330 adapted to other portable container designs, such as suit cases, traveling display cases, camera cases, etc., may suffice.

Figure 4:
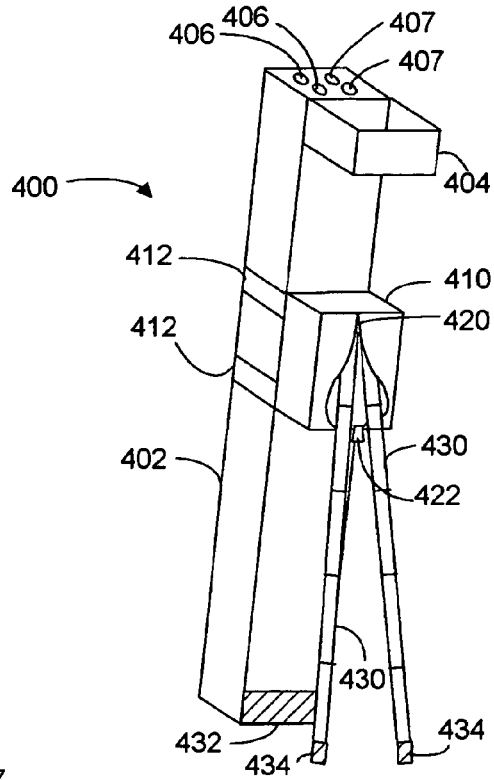
FIG. 4 is a perspective view illustrating a third exemplary embodiment of the portable container support system, or pool cue support system, according to the present invention.

FIG. 4 is a perspective view illustrating a third exemplary embodiment of the portable container support system, or pool cue support system 400, according to the present invention. Pool portable container system 400 has a single re-closable enclosure 410 adjustably and releasably coupled to pool cue portable container 402 via releasable coupling 412, illustrated as two straps. Frontal closure 420 is preferably a zipper, operable with closure mechanism 422, preferably a zipper pull. Other types of closures 320, as mentioned above relating to FIG. 1, are also preferred in alternate preferred embodiments. Extendable, or deployable, segmented supports 430 are preferably coupled to the rear interior surface of re-closable enclosure 410. Pool cue shaft bores 407 and pool cue handle bores 406 are preferably arranged pair-wise, but may be in any configuration in other embodiments. Lid 404 preferably has a semi-circumferential closure, such as a zipper, for securing the lid 404 to pool cue portable container 402. Feet 432 and 434 are preferably configured to reduce slippage on smooth surfaces and on carpeted floors. Those skilled in the art, upon reading the teachings of this specification, will appreciate that, under appropriate circumstances, considering such issues as market forces, user preferences, and intended use, other re-closable enclosures 410, such as re-closable enclosures having closures 420 of various types, locations, orientations and configurations, etc., may suffice.

Figure 5:
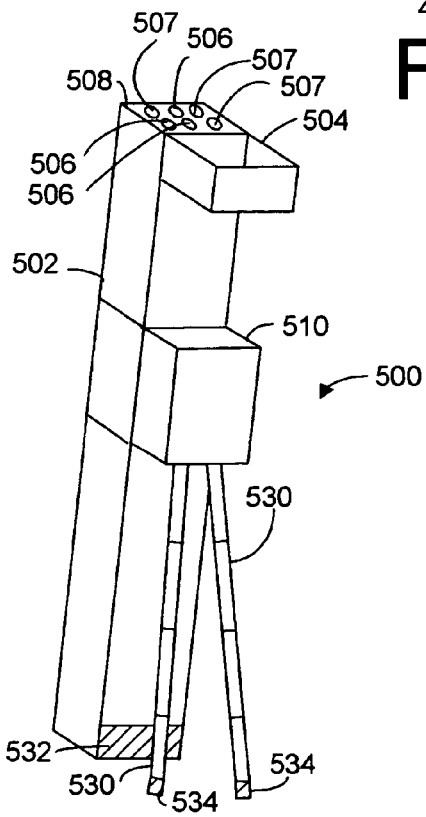
FIG. 5 is a perspective view illustrating a fourth exemplary embodiment of the portable container support system, or pool cue support system, according to the present invention.

FIG. 5 is a perspective view illustrating a fourth exemplary embodiment of the portable container support system, or pool cue support system 500, according to the present invention. Pool cue system 500 is preferably a single, bottom-opening re-closable enclosure 510 adjustably and releasably coupled to pool cue portable container 502 with releasable coupling 512, which is illustrated as a single broad strap. Re-closable enclosure 510 is preferably sufficiently rigid to protect the legs 530, when stowed therein, from the hazards of transport and luggage handling. In an alternate embodiment, re-closable enclosure 510 is preferably rigid and has a hinged door with a latch for a closure 510. Extendable, or deployable, segmented supports 530 are preferably coupled to the rear interior surface of re-closable enclosure 410 but may be coupled at any point at least partially interior to re-closable enclosure 410. Feet 534 and 532 are preferably adapted for high friction in contact with floors. Cue shaft bores 507 and cue handle bores 506 are arranged in core 508 to provide stability and balance when the portable container is used as a pool cue stand. Lid 502 is shown in the open position and is preferably semi-rigid and more preferably rigid with interior padding to protect the ends of pool cue shafts and handles during transport. Those skilled in the art, upon reading the teachings of this specification, will appreciate that, under appropriate circumstances, considering such issues as market forces, user preferences, and intended use, other approaches for improving balance and stability, such as weighting the bottom of the pool cue portable container 502, angling the pool cue shaft bores 507 to hold cues vertically when the portable container 502 is supported in an inclined position, etc., may suffice.

In another alternate embodiment, the bottom of the re-closable enclosure 510 preferably uses feet 534 as the closures of adaptively shaped and sized openings in the bottom portion of re-closable enclosure 510. In this alternate embodiment, the supports 530 are preferably rigidly coupled to the interior of the re-closable enclosure 510 and are preferably spring-biased telescoping legs which telescope into and out of the adaptively shaped and sized openings, or holes, such that, in the stowed position, the feet 534 close the holes. The rigid coupling is preferably angled to direct the supports 530 into a desired tripod configuration with the portable container 502 as one leg.

Figure 6:
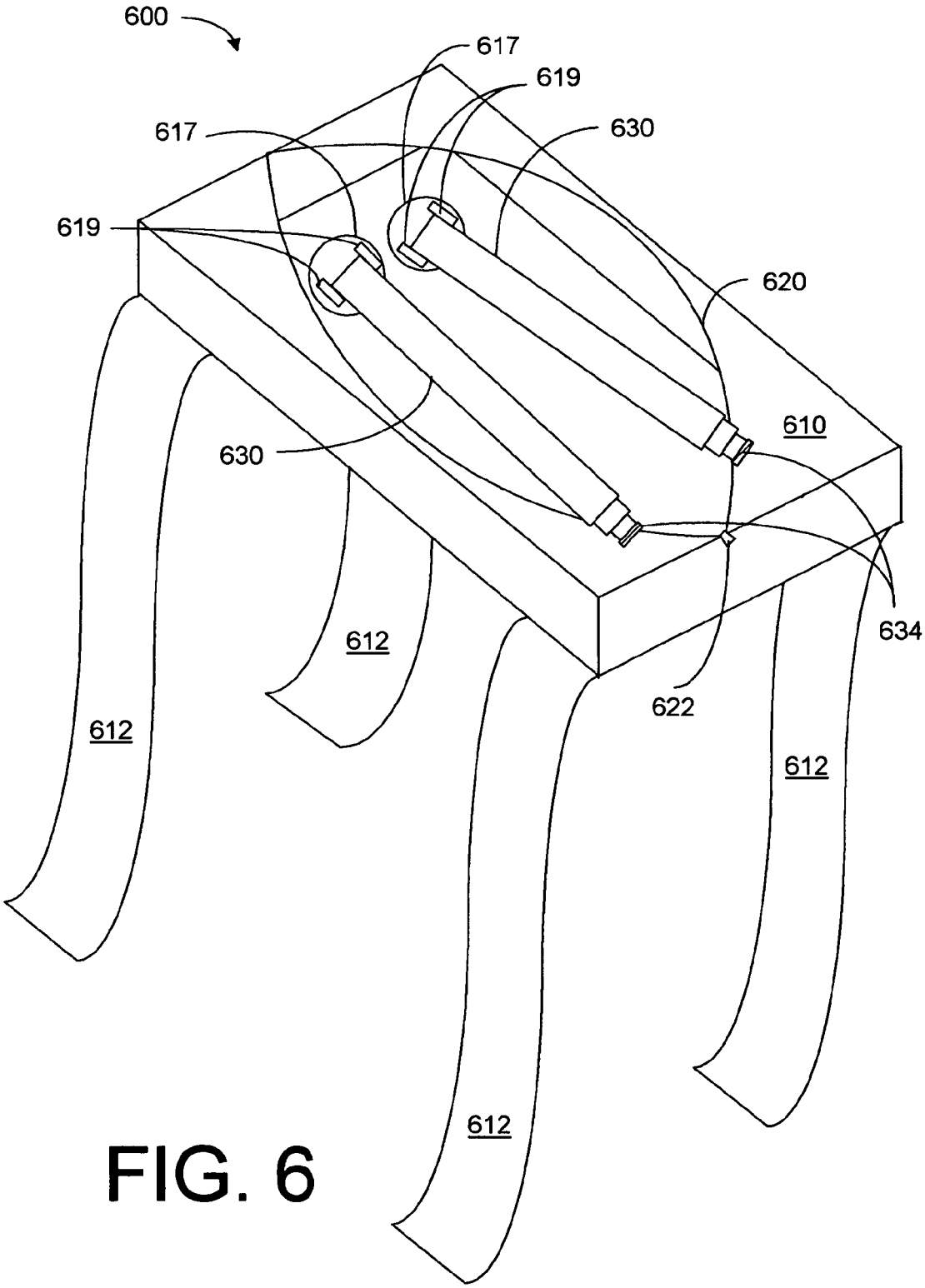
FIG. 6 is a perspective view illustrating a fifth exemplary embodiment of the portable container support system, or pool cue support system, according to the present invention.

FIG. 6 is a perspective view illustrating a fifth exemplary embodiment of the portable container support system, or pool cue support system 600, according to the present invention. Re-closable enclosure 610 is shown with closure 620, illustrated as a zipper with pull-tab 622, in an open position with supports 630 partially deployed through closure 620. Couplings 617 provide rotation about a first axis and brackets 619 hold an axle for rotation about a second axis. Feet 634 are preferably adapted to frictionally engage a surface when in use. Releasable couplings 612, illustrated as straps, are preferably integral to re-closable enclosure 610 but may, in some alternate embodiments be releasable from the re-closable enclosure 610. Re-closable enclosure 610 is preferably sufficiently rigid to provide protection for the supports 630 during transport and luggage handling. Supports 630 are illustrated as telescoping legs, which may be locked in various telescoped positions by means known in the art of telescoping tripod legs. It will be understood that re-closable enclosure 610 is preferably sized and shaped adaptive to various cases and applications, and that the invention is not limited to re-closable enclosures 610 of a particular shape and size. Those skilled in the art, upon reading the teachings of this specification, will appreciate that, under appropriate circumstances, considering such issues as market forces, user preferences, and intended use, other releasable couplings 612, such as snaps, clamps, hook and loop fasteners, etc., may suffice. Pool cue support system 600 may be adapted to any container 102, 302, 402, 502, or others mentioned below, that need to be supported in a preferred orientation, including, without limitation, flexible bags suspended by the top rim, laptop computer cases supported underneath by four extendable supports 1230 to provide a laptop computer desk, briefcases, luggage, exhibit containers, containers of goods for sale, and even non-traditional containers, such as human beings, may be supported in a preferred orientation by various alternate embodiments of pool cue support system 600.

Figure 7:
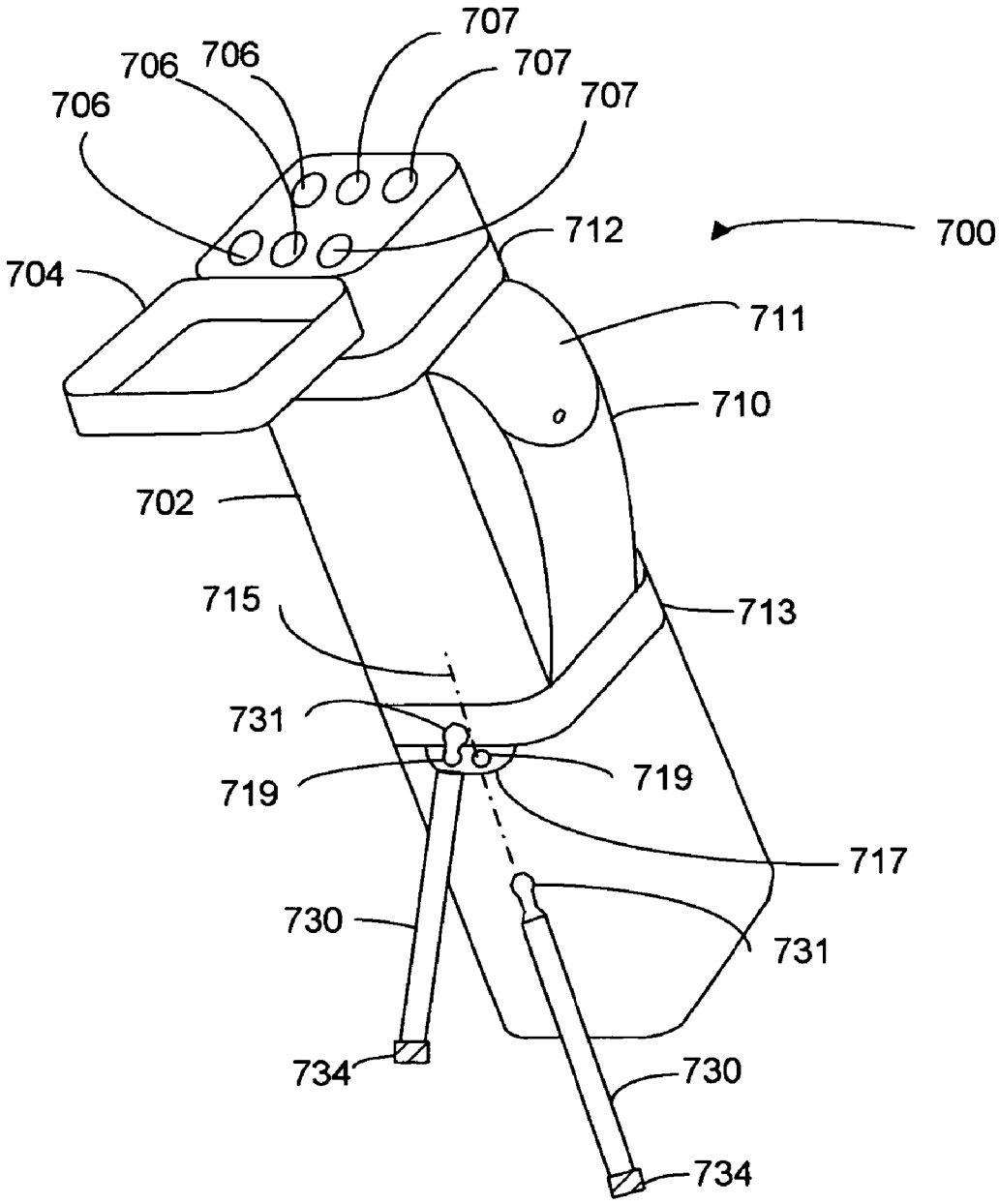
FIG. 7 is a perspective view illustrating a sixth exemplary embodiment of the portable container support system, or pool portable container cue system, according to the present invention.

FIG. 7 is a perspective view illustrating a sixth exemplary embodiment of the portable container support system, or pool cue support system 700, according to the present invention. Re-closable enclosure 710 is preferably coupled to pool cue portable container 702 using releasable couplings 712 and 713, illustrated as straps. Coupling 713 is preferably a strap of resilient material such as thick leather or the tough material used to make mud flaps for trucks. Coupling 713 has a flange 717 having two bores 719 there through. Supports 730 with feet 734 are preferably stowable in re-closable enclosure 710. Each support 730 preferably has a pin 731 in the end of support 730 opposite the end having foot 734. Each pin 731 is shaped and sized to be inserted and held in a bore 719, illustrated as insertion along line 715. The force exerted by the resiliency of the material holds the supports 730 in position. In alternate embodiments, flange 717 is preferably placed variously on the upper coupling 712, on the re-closable enclosure 710, or in the re-closable enclosure 710. For example, flange 717 may be integral to closure 711, illustrated as a flap to re-closable enclosure 710. Those skilled in the art, upon reading the teachings of this specification, will appreciate that, under appropriate circumstances, considering such issues as market forces, user preferences, and intended use, other approaches to making coupling 713, such as angled bores 719, bores in flap 711, additional mechanical constraints to maintain preferred positions of supports 730, and supports 730 of various designs, etc., may suffice.

Figure 8:
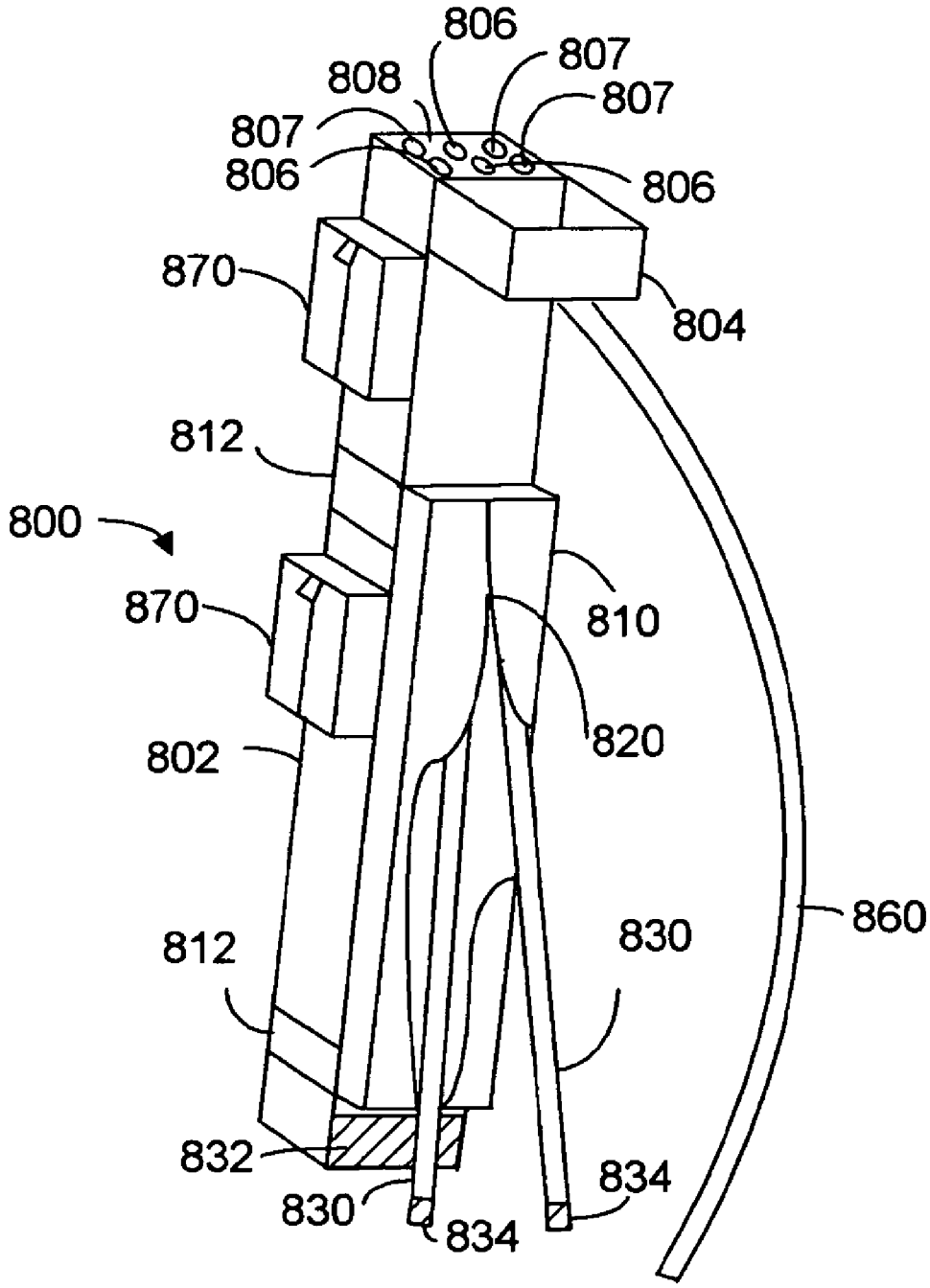
FIG. 8 is a perspective view illustrating a seventh exemplary embodiment of the portable container support system, or pool portable container cue system, according to the present invention.

FIG. 8 is a perspective view illustrating a seventh exemplary embodiment of the portable container support system, or pool cue support system 800, according to the present invention. Re-closable enclosure 810 is adjustably and releasably coupled to pool cue portable container 812 using releasable couplings 812, which are illustrated as straps. Closure 820 is shown in the open position with non-segmented supports 830 deployed there through. Feet 832 and 834 are preferably adapted to reduce slippage on floors. Pool cue shaft bores 807 and pool cue handle bores 806 in core 808 are preferably adapted to particular cue types, where appropriate. This embodiment illustrates that the supports 830 need not be extendable. Lid 804, shown in the fully open position, is operable to be fastened over the top end of portable container 802. Zippered pouches 870 may be attached to any surface of the portable container 802, but are shown on the side for clarity of the drawing. Shoulder strap 860 is shown disconnected at one end for clarity in the drawing: the disconnected end is normally attached near the foot 832. It is preferable to have the foot 832, the lid 804, the re-closable enclosure 810, and the shoulder strap on the same side of the portable container 802. Those skilled in the art, upon reading the teachings of this specification, will appreciate that, under appropriate circumstances, considering such issues as market forces, user preferences, and intended use, other arrangements of the shoulder strap 860, the re-closable enclosure 810, the zippered pouches 870, such as placing some of the items on various sides of portable container 902, adding a carrying handle, etc., may suffice.

Figure 9A:
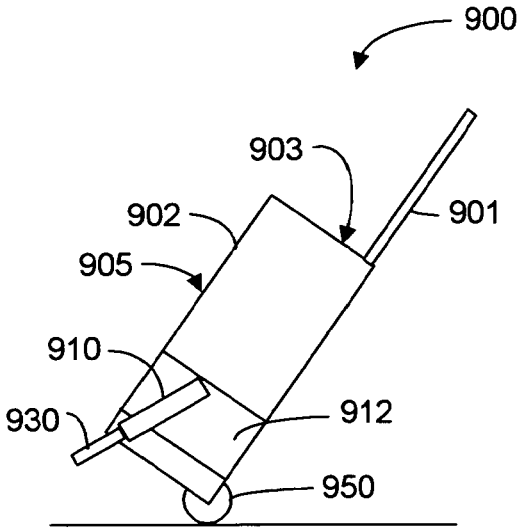
FIG. 9A is a side elevation view illustrating an eighth exemplary embodiment of the portable container support system according to the present invention.

FIG. 9A is a side elevation view illustrating an eighth exemplary embodiment of the portable container support system, or pool cue support system 900, according to the present invention. FIG. 9A shows the portable container 902 in a position to be pulled by a person via handle 901. Re-closable enclosure 910 is preferably coupled to portable container 902 with releasable coupling 912, shown as a strap, in a position to extend support 930 to support portable container 902 in the generally upright position. Carry-on luggage, for example, is often unstable in an upright position because people piggy-back other luggage on top surface 903, making unstable a portable container 902 that was originally designed to be stable. One popular technique is to piggy-back a laptop computer portable container or other additional luggage on surface 905, creating a torque about wheel 950 which tends to tip the luggage over backwards. In this configuration, the handle 901 transmits an upward force on the hand of the person pulling the portable container 902. As a result, the person pulling the portable container 902 does not have to lift any weight when pulling on level ground. This makes pulling the portable container 902 a great deal easier, but then the portable container 902 falls over when parked. By adding the enclosable and deployable support 930 to the portable container 902, a portable container 902 used in piggy-back mode can be made to stand nearly upright when parked. Those skilled in the art, upon reading the teachings of this specification, will appreciate that, under appropriate circumstances, considering such issues as market forces, user preferences, and intended use, other arrangements of the re-closable enclosure 910, such as placing the re-closable enclosure 910 on surface 905, having two re-closable enclosures 910, etc., may suffice.

Figure 9B:
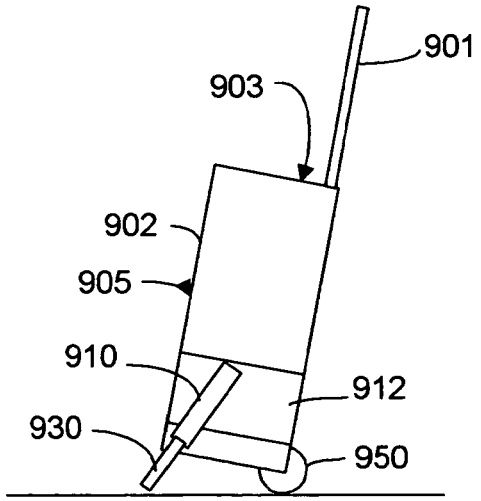
FIG. 9B is a side elevation view illustrating an eighth exemplary embodiment of the portable container support system, as shown in FIG. 9A, according to the present invention.

FIG. 9B is a side elevation view illustrating an eighth exemplary embodiment of the portable container support system, or pool cue support system 900 as shown in FIG. 9A, according to the present invention. FIG. 9B shows the portable container 902 in an upright position, supported by support 930.

Figure 10A:
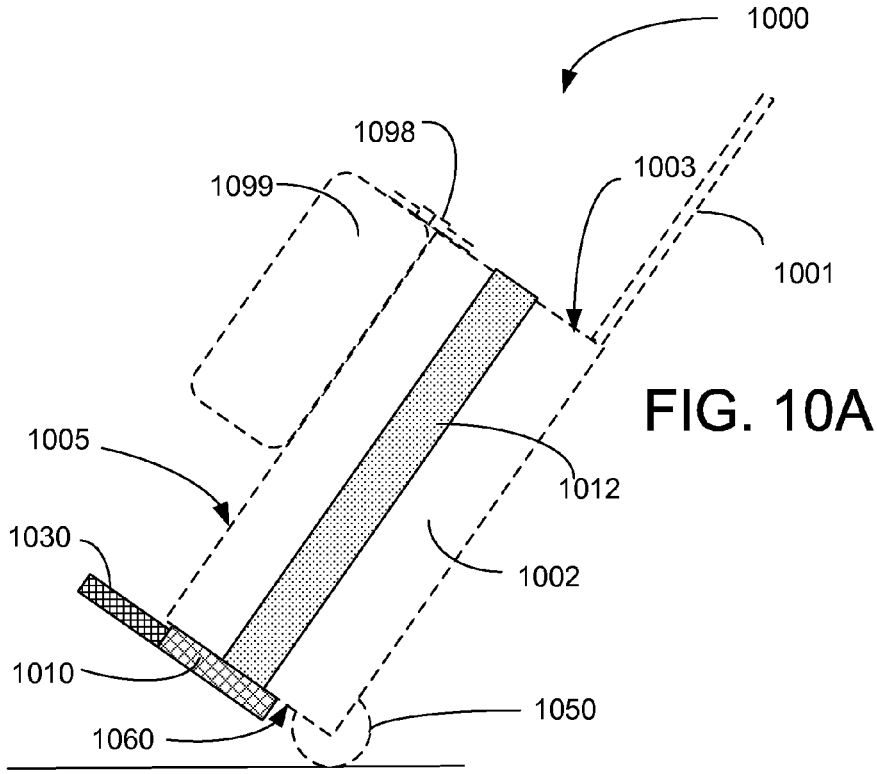
FIG. 10A is a side elevation view illustrating a fifteenth exemplary embodiment of the portable container support system, according to the present invention.
Figure 10B:
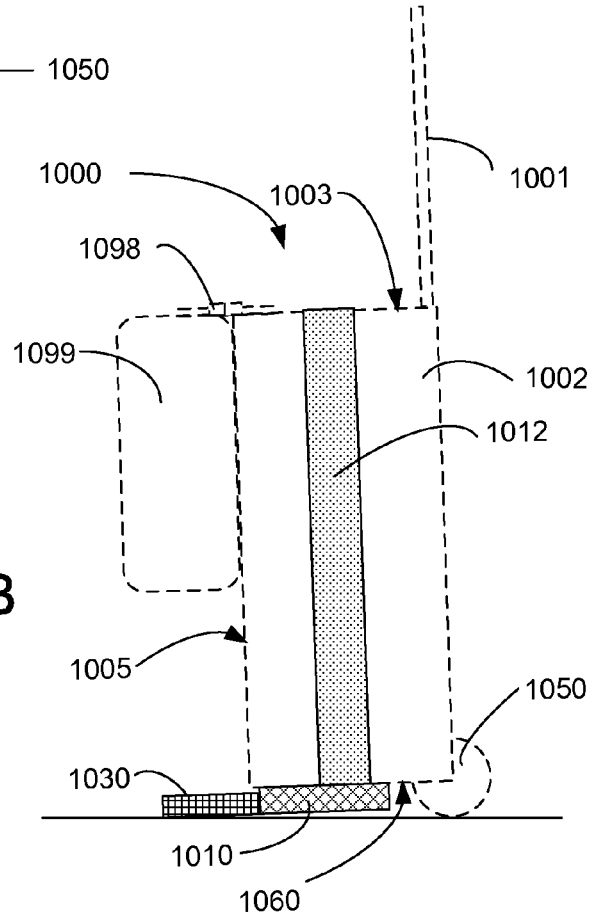
FIG. 10B is a side elevation view illustrating a fifteenth exemplary embodiment of the portable container support system as shown in FIG. 10A, according to the present invention.

FIG. 10A is a side elevation view illustrating a fifteenth exemplary embodiment 1000 of the exemplary portable container support system, according to the present invention. Portable container support system 1000 extends the use of the present invention to various portable containers. FIG. 10A shows the portable container, or portable container, or luggage, 1002 in a position to be pulled by a person via handle 1001. FIG. 10B shows the portable container 1002 in an upright position, supported by extendable and deployable support 1030. Re-closable enclosure 1010 is preferably coupled to portable container 1002 with releasable coupling 1012, shown as a strap, in a position to extend support 1030 parallel to the floor to support portable container 1002 in the generally upright position. While the releasable coupling 1012 is shown strapped around the sides of the portable container 1002, it may also be employed strapped front to back. Support 1030 is coupled to the interior of re-closable enclosure 1010 using a support coupling (not shown). The support coupling is preferably coupled to the inside of the re-closable enclosure distal the opening though which the supports 1030 extend, thereby maximizing the cantilever action of the support 1030. Preferably, support 1030 is a pair of supports 1030 that extend proximate the sides of the portable container. Preferably, the re-closable enclosure 1010 is made of a tough material for this application.

Carry-on luggage is often unstable in an upright position because people piggy-back other luggage on top surface 1003, making unstable a portable container 1002 that was originally designed to be stable. The cantilever action of the deployed support 1030 assists in keeping the portable container 1002 upright when parked. Another popular technique is to piggy-back a laptop computer portable container or other additional luggage 1099 on back surface 1005, securing the additional luggage 1099 using buckled straps 1098. This arrangement creates a torque about wheel 1050, which tends to tip the luggage 1002 and 1099 over backwards (counter clockwise, in this view). In this configuration, the handle 1001 transmits an upward force on the hand of the person pulling the portable container 1002. As a result, the person pulling the portable container 1002 does not have to lift any weight when pulling on level ground. This makes pulling the portable container 1002 a great deal easier, but then the portable container 1002 falls over when parked. By securing re-closable enclosure 1010 to the bottom surface 1060 of portable container 1002, the support 1030 can be deployed and extended to support a portable container 1002 used in piggy-back mode in a substantially upright orientation when parked by using the cantilever action of the extendable and deployable support 1030. In an alternate embodiment, the re-closable enclosure 1010 may be permanently affixed to the bottom surface 1060 of portable container 1002 and releasable coupling 1012 may be omitted. Those skilled in the art, upon reading the teachings of this specification, will appreciate that, under appropriate circumstances, considering such issues as market forces, user preferences, and intended use, other arrangements of the re-closable enclosure 1010, such as placing the re-closable enclosure 1010 on surface 1005, having two re-closable enclosures 1010, etc., may suffice.

Figure 11:
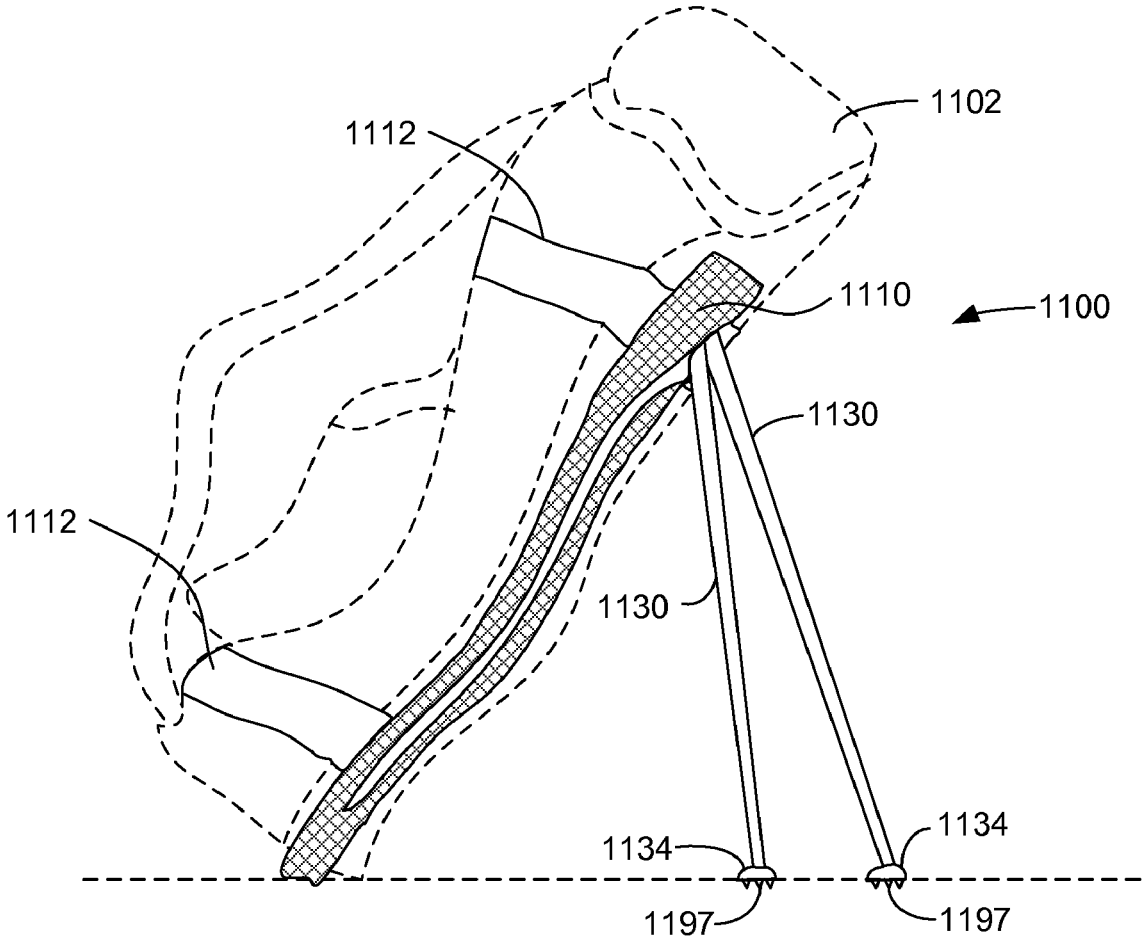
FIG. 11 is a side view illustrating a ninth exemplary embodiment of the portable container support system, according to the present invention.

FIG. 11 is a side view illustrating a ninth exemplary embodiment 1100 of the exemplary portable container support system, according to the present invention. Re-closable enclosure 1110 is preferably coupled to portable container 1102 with releasable coupling 1112, shown as straps, in a position to extend supports 1130 to support golf bag, or container, 1102 in the generally upright position. Supports 1130 have feet 1134 with cleats 1197 adapted to engage turf. In an alternate embodiment, the re-closable enclosure may be built into the golf bag 1102. In another alternate embodiment, the re-closable enclosure 1110 may be coupled to the golf bag 1102 with alternate releasable couplings 1112, such as snaps, buttons, hook and loop fasteners, or the like. In still yet another alternate embodiment, the re-closable enclosure 1110 may be affixed onto the exterior of the golf bag, for example, by stitching. In a particular embodiment, the re-closable enclosure 1110 may at least partially intrude interior to the golf bag 1102. While supports 1130 are shown as fixed-length supports 1130, any type of support 1130 may be used. For example, in an alternate embodiment, re-closable enclosure 1110 may be much shorter than the golf bag 1102 and the supports 1130 enclosable in the re-closable enclosure 1110 may be extendable.

Re-closable enclosure 1110 may fully contain a mechanism for deploying supports 1130 in response to pressure from the weight of the golf bag 1102 on the portion of re-closable enclosure 1110 proximate the ground. As the golf bag 1102 is lowered to the ground in an upright position, the force on the bottom portion of the re-closable enclosure 110 activates a mechanical linkage and forces the supports 1130 to deploy. The re-closable enclosure 1110 must be open for this mechanism to function with the present invention.

Figure 12:
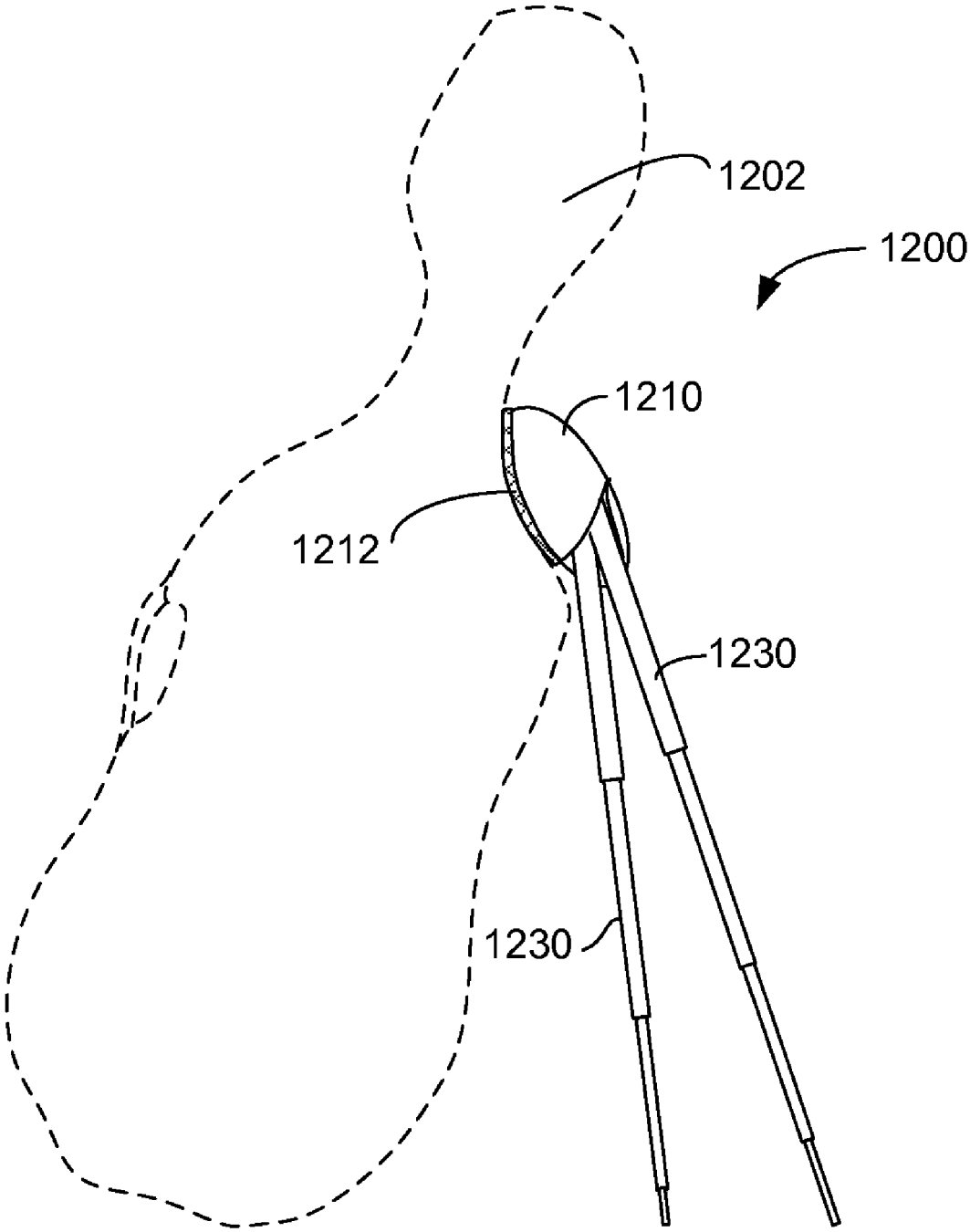
FIG. 12 is a side elevation view illustrating a tenth exemplary embodiment of the portable container support system, according to the present invention.

FIG. 12 is a side elevation view illustrating a tenth exemplary embodiment 1200 of the portable container support system, according to the present invention. Re-closable enclosure 1210 is shown attached to a musical instrument portable container, or portable container, 1202. The musical instrument portable container 1202 is an example of a container that does not open at the top. With such containers 1202, using a strap as a releasable coupling 1212 may be less convenient. The re-closable enclosure 1210 is shown coupled to the container 1202 without a strap. The releasable coupling 1212 is preferably by hook and loop fasteners 1212.

Figure 13A:
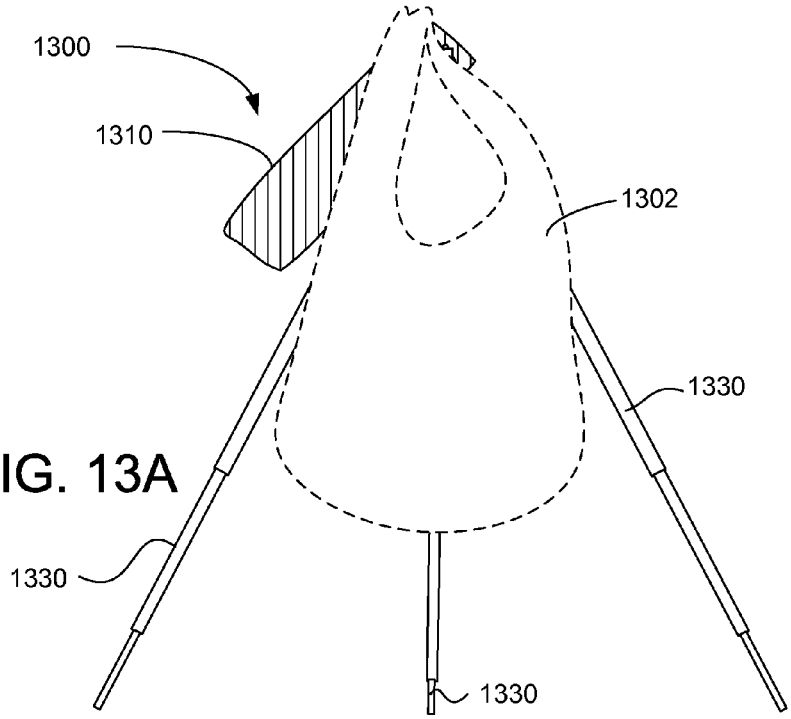
FIG. 13A is a side elevation view illustrating an eleventh exemplary embodiment of the portable container support system, according to the present invention.

FIG. 13A is a side elevation view illustrating an eleventh exemplary embodiment 1300 of the portable container support system, according to the present invention. Re-closable enclosure 1310 is shown attached to a sports equipment bag 1302, or portable container, 1302. The sports equipment bag 1302 is an example of a container that is not rigid. With such containers 1302, the container 1302 must be supported from the top. The re-closable enclosure 1310 is shown open with stowable, extendable, and deployable legs 1330 formed in a tripod structure. The first releasable coupling 1312 and the second releasable coupling 1313 are not visible in this view, but see FIGS. 13B and 13C, below.

Figure 13B:
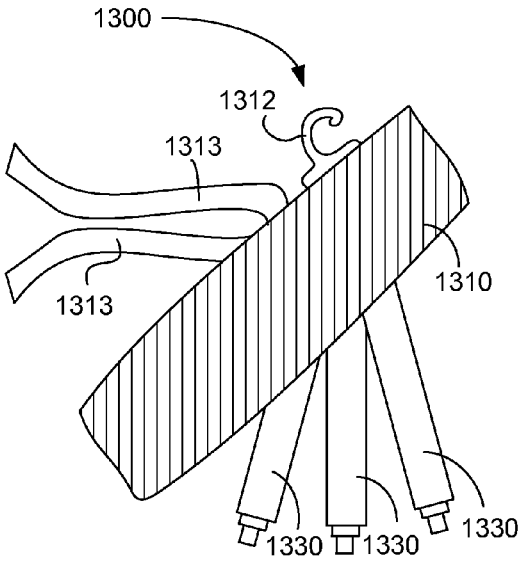
FIG. 13B is a side elevation view illustrating the eleventh exemplary embodiment of the portable container support system, as shown in FIG. 13A, according to the present invention.

FIG. 13B is a side elevation view illustrating the eleventh exemplary embodiment 1300 of the portable container support system, as shown in FIG. 13A, according to the present invention. Supports 1330 are showed deployed but not extended. From re-closable enclosure 1310. First releasable coupling 1312 is shown as a hook on a side of the re-closable enclosure 1310 opposite the side through which the supports 1330 are deployed. In various alternate embodiments, other first releasable couplings 1312 may be used. For example, the first releasable coupling 1312 may be a carbineer, a snap buckle, a hook on a flexible chain, or the like. In various alternate embodiments, the first releasable coupling 1312 may be located elsewhere on the re-closable enclosure 1310. Second releasable coupling 1313 is shown as a pair of ties. This embodiment illustrates that more than one releasable coupling 1312 and 1313 may be used with one re-closable enclosure 1310. In various alternate embodiments, other second releasable couplings may be used.

Figure 13C:
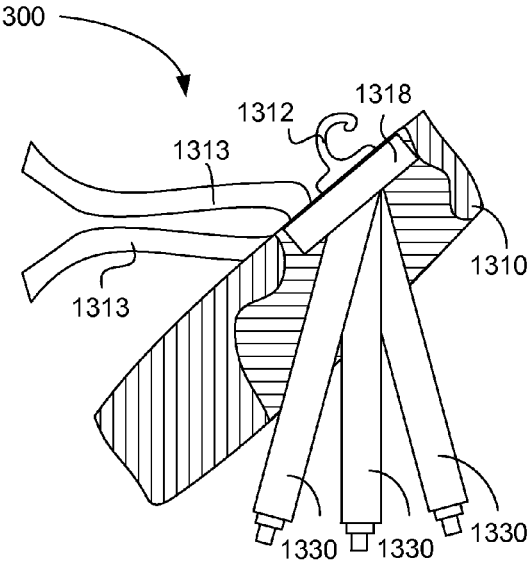
FIG. 13C is a side elevation cutaway view illustrating the eleventh exemplary embodiment of the portable container support system, as shown in FIG. 13B, according to the present invention.

FIG. 13C is a side elevation cutaway view illustrating the eleventh exemplary embodiment 1300 of the portable container support system, as shown in FIG. 13B, according to the present invention. The cutaway reveals support coupling 1318, which serves to retain one end of each support 1330. Support coupling 1318 may also constrain the possible orientations of supports 1330 to create a tripod. In this preferred embodiment, first releasable coupling 1312 may connect to support coupling 1318 though openings in the material of the re-closable enclosure 1310 which openings would be closed with screws, bolts, or other fasteners connecting the releasable coupling 1312 to the support coupling 1318.

Figure 14A:
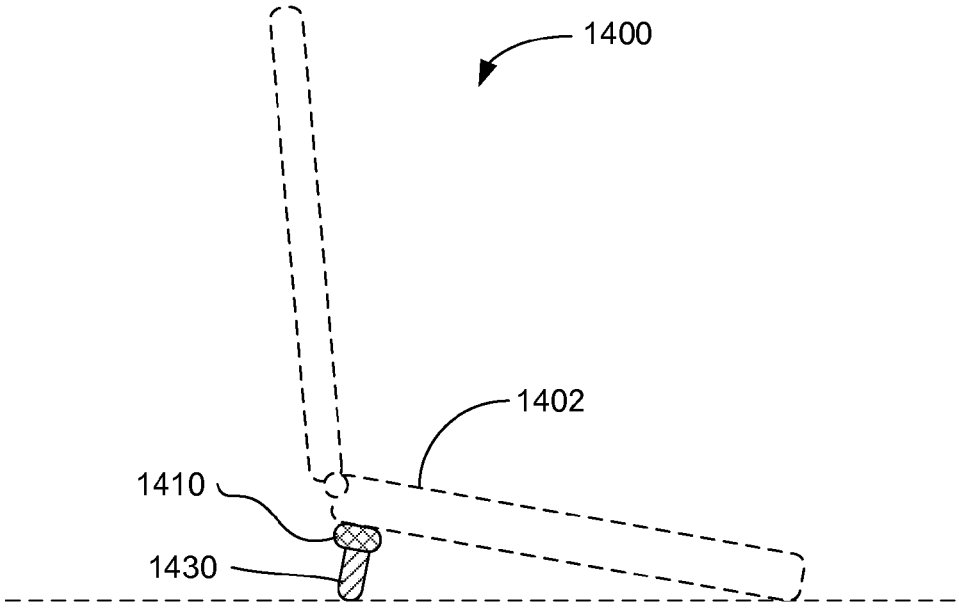
FIG. 14A is a side elevation view illustrating a twelfth exemplary embodiment of the portable container support system, according to the present invention.

FIG. 14A is a side elevation view illustrating a twelfth exemplary embodiment 1400 of the portable container support system, according to the present invention. The portable container 1402 of a laptop computer is supported in a preferred orientation by supports 1430 extended from re-closable enclosure 1410 that is coupled to the underside of the portable container 1402. Re-closable enclosure 1410 is preferably coupled to the underside of the portable container 1402 using hook and loop fasteners (not shown) as a releasable coupling. In addition to improving the keyboard angle for typing, embodiment 1400 also improves air circulation under the laptop portable container 1402 for cooling the computer within the portable container.

Figure 14B:
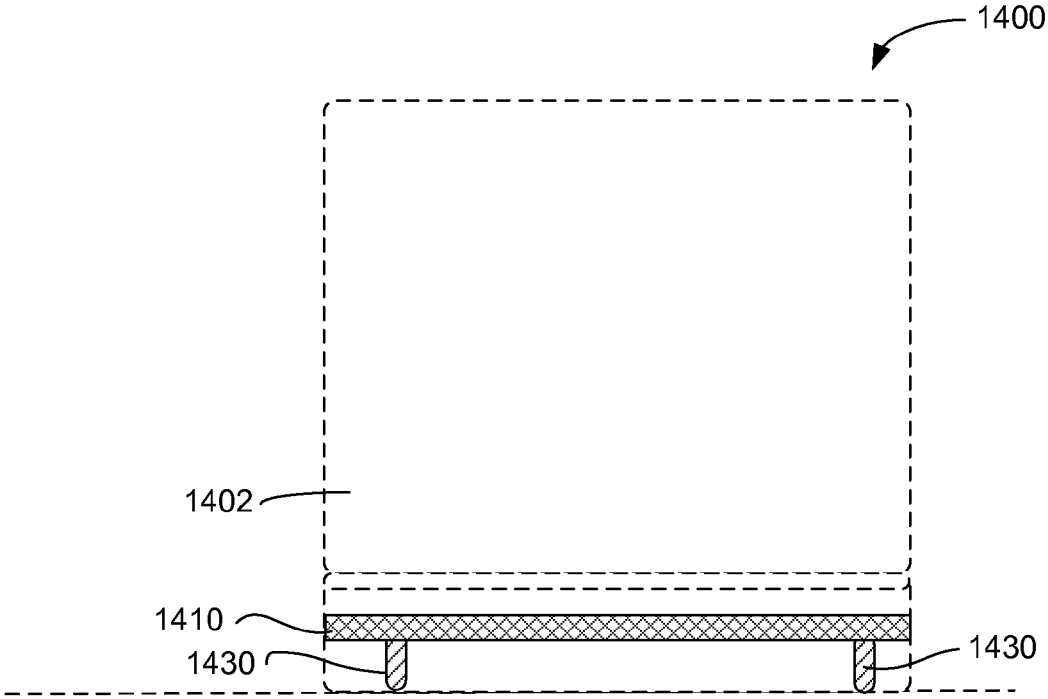
FIG. 14B is a rear elevation view illustrating a twelfth exemplary embodiment of the portable container support system, as shown in FIG. 14A, according to the present invention.

FIG. 14B is a rear elevation view illustrating a twelfth exemplary embodiment 1400 of the portable container support system, as shown in FIG. 14A, according to the present invention. The supports 1630 may extend from the re-closable enclosure 1610 either directly, or by rotation.

Figure 15A:
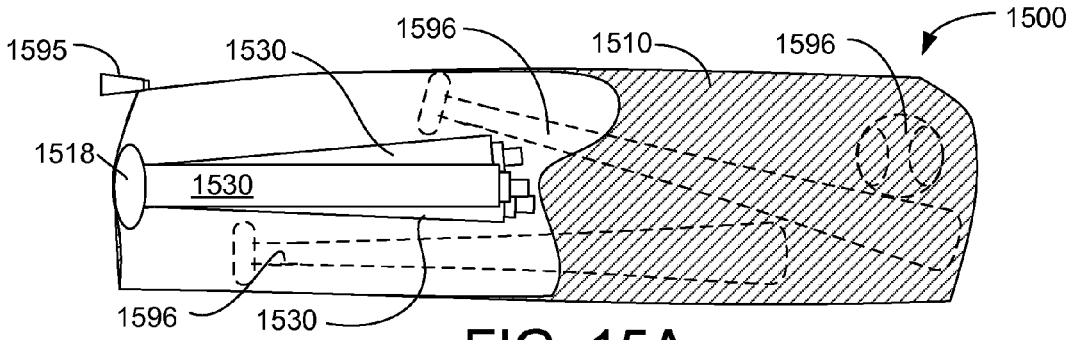
FIG. 15A is a side elevation view illustrating a thirteenth exemplary embodiment of the portable container support system in which the re-closable enclosure and the container are the same, according to the present invention.

FIG. 15A is a side elevation view illustrating a thirteenth exemplary embodiment 1500 of the portable container support system in which the re-closable enclosure 1510 and the container are the same, according to the present invention. Re-closable enclosure 1510 is a flexible bag 1510, which is sized to also contain sports equipment 1596. Support coupling 1518 is preferably fixed to an interior surface of an end of the re-closable enclosure 1510. Preferably, the area of contact between the support coupling 1518 and the re-closable enclosure 1510 is reinforced for longer wear. A zipper, indicated by zipper tab 1595, runs along at least a portion of the top (in this view) of the re-closable enclosure 1510.

Figure 15B:
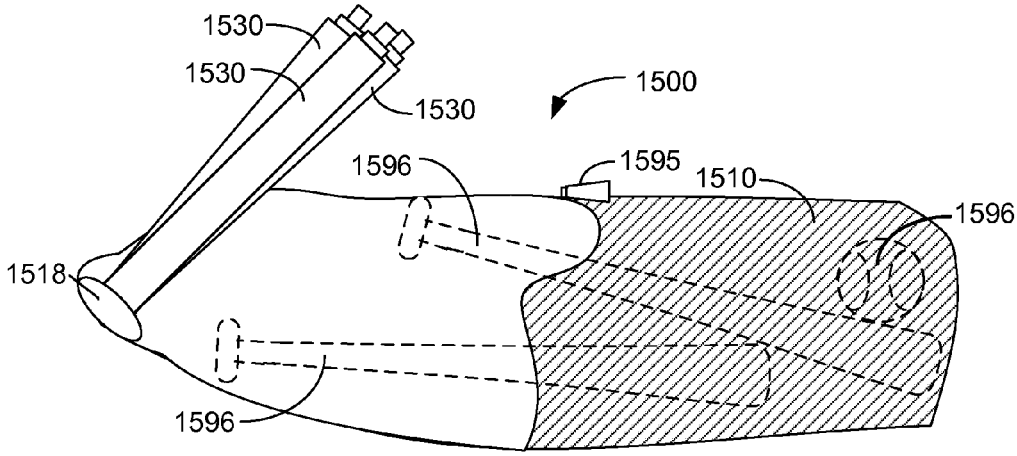
FIG. 15B is a side elevation view illustrating the thirteenth exemplary embodiment of the portable container support system as shown in FIG. 15A, with the supports partially deployed, according to the present invention.

FIG. 15B is a side elevation view illustrating the thirteenth exemplary embodiment 1500 of the portable container support system as shown in FIG. 15A, with the supports 1530 partially deployed, according to the present invention. The zipper has been opened, as indicated by the position of zipper tab 1995. The supports 1530 are partially deployed, and the displacement of the connection between the support coupling 1518 and the interior of re-closable enclosure 1510 has begun to turn an end portion of the flexible re-closable enclosure 1510 inside out.

Figure 15C:
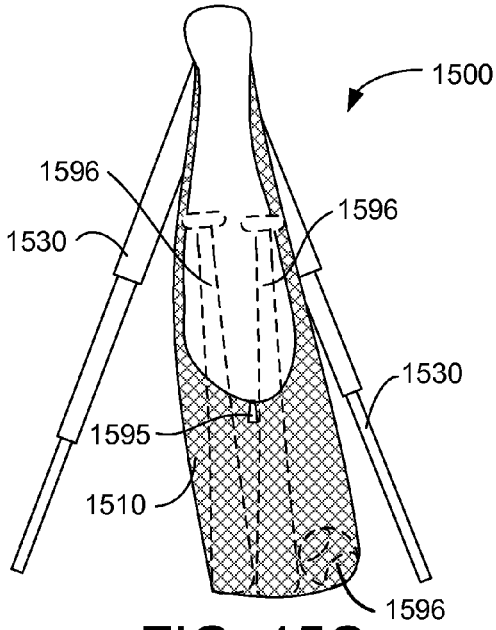
FIG. 15C is a side elevation view illustrating the thirteenth exemplary embodiment of the portable container support system as shown in FIG. 15A, with the supports fully extended and deployed, according to the present invention.

FIG. 15C is a front elevation view illustrating the thirteenth exemplary embodiment 1500 of the portable container support system as shown in FIG. 15A, with the supports 1530 fully extended and deployed, according to the present invention. The supports 1530 form a tripod (partially visible in this view). An end portion of the re-closable enclosure 1510 is turned inside out over the support coupling 1518, supporting the re-closable enclosure 1510 in an upright position. The re-closable enclosure 1510 remains open in this configuration, allowing easier access to sports equipment 1596.

Figure 16A:
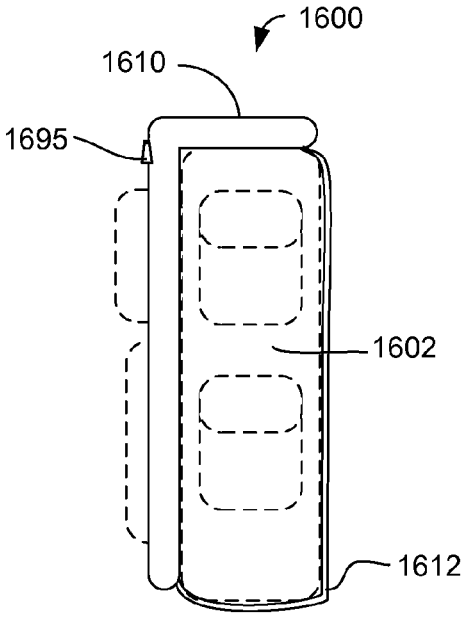
FIG. 16A is a side elevation view illustrating the fourteenth exemplary embodiment of the portable container support system, according to the present invention.

FIG. 16A is a side elevation view illustrating the fourteenth exemplary embodiment 1600 of the portable container support system, according to the present invention. Container 1602 is shown as a backpack 1602. Re-closable enclosure 1610 is shown releasably coupled to container 1602 by releasable coupling 1612, illustrated as straps. Re-closable enclosure may be opened and closed with a zipper, as indicated by zipper tab 1695, shown in a closed position. In various alternate embodiments, other closure devices may be used.

Figure 16B:
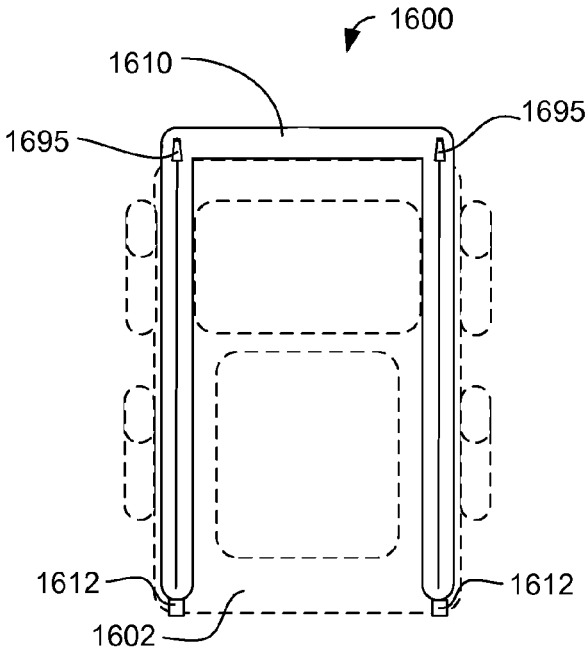
FIG. 16B is a rear elevation view illustrating the fourteenth exemplary embodiment of the portable container support system, as shown in FIG. 16A, according to the present invention.

FIG. 16B is a rear elevation view illustrating the fourteenth exemplary embodiment 1600 of the portable container support system, as shown in FIG. 16A, according to the present invention. In an alternate embodiment, the top portion of re-closable enclosure 1610 may be reduced or eliminated and two separate re-closable enclosures may be used. In yet another alternate embodiment, a single support 1630 may be used.

Figure 16C:
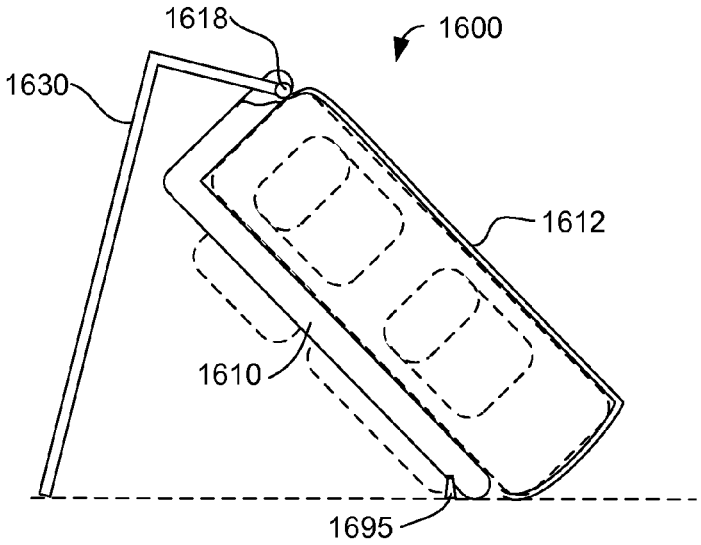
FIG. 16*c* is a side elevation view illustrating the fourteenth exemplary embodiment of the portable container support system, as shown in FIG. 16A, with the supports deployed according to the present invention.

FIG. 16C is a side elevation view illustrating the fourteenth exemplary embodiment 1600 of the portable container support system, as shown in FIG. 16A, with the supports 1630 deployed according to the present invention. Support 1630 is illustrated as a rigid support 1630 extending from support coupling 1618. In various alternate embodiments, other supports 1630, such as telescoping supports 1630, may be used.

While multiple exemplary embodiments have been presented in the foregoing detailed description, it should be appreciated that a vast number of variations exist. The number of embodiments in not intended to be an exhaustive enumeration of the possibilities, but only as an inspiration to commerce. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A portable container support system for supporting a portable container in a stationary position, such portable container adapted to releasably contain at least one article, said portable container having an exterior, said portable container support system further comprising:

at least one re-closable enclosure operable to be releasably coupled to, but not to completely enclose, said exterior of such portable container;

at least one support for such portable container, wherein said at least one support comprises substantially rigid material and is internally stowable within said at least one re-closable enclosure; and at least one support coupling coupled to said at least one re-closable enclosure, wherein said at least one support coupling is disposed entirely within said at least one re-closable enclosure;

wherein said at least one internally stowable support:

is operable to be coupled to said at least one support coupling;

is operable to be at least partially deployed external to said at least one re-closable enclosure to support such portable container in a preferred stationary position and orientation; and directly engages one of a floor and a non-floor surface external to said at least one reclosable enclosure when said at least one stowable support is at least partially deployed external to said at least one re-closable enclosure to support such portable container in a stationary position.

2. The portable container support system of claim 1, wherein said at least one support coupling is coupled to an interior surface of said at least one re-closable enclosure.

3. The portable container support system of claim 1, wherein said at least one re-closable enclosure comprises at least one releasable coupling adapted for releasably coupling said at least one re-closable enclosure to such portable container.

4. The portable container support system of claim 1, wherein said at least one internally stowable support is operable to be deployed by a mechanism internal to said at least one re-closable enclosure.

5. The portable container support system of claim 1, wherein said at least one internally disposed support comprises at least one extendable leg.

6. The portable container support system of claim 1, wherein said re-closable enclosure comprises a pouch having a closure comprising a zipper.

7. The portable container support system of claim 1, wherein said at least one support coupling is operable to maintain said at least one support in at least one fixed position.

8. A portable container support system for supporting, in a stationary position, a portable container, said portable container support system further comprising:

at least one portable container reconfigurer operable to deploy at least one support directly onto an environmental surface external to said at least one portable container reconfigurer and external to said portable container, said portable container in a preferred stationary position and orientation, and further to support objects contained in said portable container when said objects are contained in said container, wherein said at least one support comprises substantially rigid material;

at least one re-closable enclosure, operable to be releasably coupled to, but not completely enclose, an exterior surface of such portable container and operable to enclose at least part of said portable container reconfigurer when said portable container reconfigurer is in a stowed position; and wherein said at least one portable container reconfigurer comprises at least one support coupling coupled to said re-closable enclosure and disposed entirely within said at least one reclosable enclosure.

9. The portable container support system of claim 8, wherein said at least one portable container reconfigurer comprises:

at least one support coupling coupled to said re-closable enclosure; and at least one support having a proximal end operable to be coupled to said at least one support coupling and having a distal end at least partially deployable outside said at least one re-closable enclosure when said at least one re-closable enclosure is open.

10. The portable container support system of claim 9, wherein said at least one support coupling is coupled to an interior portion of said re-closable enclosure.

11. The portable container support system of claim 9, wherein said at least one support coupling is operable to maintain said at least one support in at least one fixed position.

12. The portable container support system of claim 9, wherein said at least one support is operable to be deployed by a mechanism internal to said at least one re-closable enclosure.

13. The portable container support system of claim 8, wherein said re-closable enclosure comprises a pouch having a closure comprising a zipper.

14. The portable container support system of claim 9, wherein said at least one support comprises at least one extendable leg.

15. A portable container support system for supporting a portable container in a stationary position, said portable container support system comprising:

a re-closable enclosure;

at least one support coupling coupled to at least one portion of said re-closable enclosure, wherein said at least one support coupling is disposed entirely within said reclosable enclosure;

at least one support having a proximal end operable to be coupled to said at least one support coupling and a distal end at least partially deployable outside said re-closable enclosure to directly engage an environmental surface, wherein said at least one support comprises substantially rigid materials; and at least one adaptation for enabling coupling of said reclosable enclosure to such portable container, wherein said coupling of said reclosable enclosure is not operable to completely enclose such portable container with said reclosable enclosure;

wherein said at least one support is operable to support such portable container in a stationary position and preferred orientation.

16. The portable container support system of claim 15, wherein said at least one support coupling comprises at least one support coupling coupled to an interior portion of said re-closable enclosure.

17. The portable container support system of claim 15, wherein said at least one support comprises at least one extendable leg.

18. The portable container support system of claim 15, wherein said at least one adaptation for enabling coupling of said re-closable enclosure with such portable container comprises at least one adaptation for coupling of said re-closable enclosure to at least one bottom surface of such portable container.

* * * * *